United States Patent [19]

Wallman

[11] Patent Number: 4,903,849

[45] Date of Patent: Feb. 27, 1990

[54] TAMPER EVIDENT CAP AND BOTTLE

[76] Inventor: Irwin Wallman, 41 Irish Hill Rd., Shelburne, Vt. 05482

[21] Appl. No.: 342,732

[22] Filed: Apr. 24, 1989

[51] Int. Cl.[4] ..... B65D 41/48

[52] U.S. Cl. ..... 215/256; 215/305

[58] Field of Search ..... 215/256, 320, 305

[56] References Cited

U.S. PATENT DOCUMENTS

| | | | |
|---|---|---|---|
| 2,573,552 | 10/1951 | Detzel | 215/305 X |
| 3,338,446 | 8/1967 | Faulstich | 215/42 |
| 4,162,736 | 7/1979 | Faulstich | 215/256 |
| 4,166,552 | 9/1979 | Faulstich | 215/256 |
| 4,202,455 | 5/1980 | Faulstich | 215/31 |
| 4,305,517 | 12/1981 | Dennis | 215/256 |

*Primary Examiner*—Donald F. Norton

[57] ABSTRACT

A tamper evident push-on type integral synthetic plastic closure cap for an externally beaded container neck, the body of the cap being formed with a thin central disk region, a thicker surrounding rim region, an interior ridged inner skirt provided with an interior sloping wall portion descending from the inner edge of the rim region, and an outer skirt descending from the outer edge of the rim region, the outer skirt being provided with an arcuate, buttressed lifting tab extending horizontally from a portion of the outer skirt, two inward projecting ribs on the internal side of the skirt, a circumferential weakened region in the skirt disposed between the ribs separating the skirt into distinct upper and lower regions and a descending tear tab projecting downwardly from the lower edge of the lower region of said skirt so that lifting of the tab will break the wall of the skirt and separate the skirt at the weakened region to detach the lower skirt and rib from the remainder of the cap by tearing along the circumferential weakened region.

10 Claims, 3 Drawing Sheets

TAMPER EVIDENT CAP AND BOTTLE

This invention relates to caps for bottles or other containers and especially those used for liquids. The invention particularly relates to those caps which will show evidence of tampering and more particularly to those caps in which part of the cap, i.e. the tear ring, is destroyed or pulled off the remainder of the cap by the consumer in removing the cap from the container.

At the present time many materials and especially fluids, such as milk, are marketed in molded polyethylene jugs or bottles. The necks of the containers are molded with one or more parallel, external, circumferential beads therein to co-act with ribs on the caps so that the caps cannot be easily removed from the bottles without removing or otherwise destroying a portion of the cap placed thereon.

The caps are formed with one or more internal locking ribs that will cam over the external beads on the neck of the bottle as the cap is pushed down over them. In this way the cap will be secured on the neck of the bottle and cannot be easily removed therefrom without removing the locking bead formed as an integral part of the tear ring portion of the cap from the remainder of the cap.

Caps of this nature are shown in U.S. Pat. Nos. 3,338,446; 4,162,736; 4,166,552; 4,202,455, and 4,305,517. Each of these patents use a tear ring whereby the lower portion of the cap bearing the internal locking rib can be readily detached from the remainder of the cap thus indicating the the container has been opened following its initial sealing at its point of origin.

Each of these prior art caps has a significant drawback in that they can be removed, from the neck of the bottle upon which they have been placed, without pulling off the tear ring. The design of these caps is such that application of external lifting and/or twisting forces to these prior art caps permits sufficient flexing of the cap so that the locking rib, on the cap, will release from the beads, on the neck of the bottle, without first pulling off the tear ring. This unauthorized removal of the cap permits tampering with the contents without showing evidence on the cap of such tampering.

Further, because of the design of these caps, even after these tear rings have been removed, by the consumer, the remaining portion of these prior art caps can be difficult for the consumer to remove. Yet the cap can be too easily forced off the neck of the bottle by unexpected or undesirable causes such as by increasing the internal pressure within the bottle or by dropping the bottle. Also, for example, apple cider that has started to ferment will, because of rising internal pressure caused by warming, cause the prior art caps to pop open. Also applying pressure to the bottle or dropping the bottle can cause the prior art caps to fly off.

The present invention provides an improved cap for such bottles and is designed to avoid all the above described difficulties of the prior art while remaining compatible with all existing unthreaded bottle dimensions and cap application equipment.

An aspect of the invention is to provide a cap which, while its tear ring is intact, becomes even more securely fastened to the neck of the bottle when lifting and twisting forces are applied thereto and yet, once its tear ring is removed is readily and easily removable from and easily resealable onto the bottle by the consumer.

The cap of the present invention, because of its unique design, is also more resistant to internal pressure forces caused by dropping or squeezing.

An additional aspect of the invention is to reduce the amount of force required to place the cap on the bottle thus allowing the use of thinner walled bottles and thereby saving material used in producing the bottle.

A further aspect of the present invention is to provide a press-on bottle cap which after the tear ring is removed, gives the consumer an audible signal as it is snapped on to the bottle.

A still further object of the present invention is to provide a tamperproof cap that cannot be removed without removing the tear ring.

In its preferred embodiment, the invention will be described as a plastic cap which is to be pressed onto an externally beaded neck of a bottle where it locks on to the bottle and positively cannot be removed therefrom without removing or destroying a portion of the wall of the cap where it locks onto the bottle.

BRIEF DESCRIPTION OF THE INVENTION

The present invention is especially directed towards a molded plastic cap having a flat, smooth, disklike upper surface having a central region and a thicker outer rim region surrounding the central region, a thin walled exterior skirt descending smoothly down from the outer edge of the rim region, a score line extending circumferentially around the exterior skirt to divide the exterior skirt into an upper section and a lower tear ring section, continuous, circumferential, ribs on the inner wall of said skirt above and below said score line and an inner, positive sealing, guide skirt descending from the inner edge of said rim region, characterized by the central region of the said surface being thinner than the outer rim region and a small arcuate tab positioned on and orthogonal to the exterior skirt below the disklike surface but above the level of the uppermost circumferential rib on the inner wall of said skirt which tab is supported by an arcuate buttress, coextensive with a substantial portion of the lower surface of the tab, which extends below the level of the said uppermost circumferential rib.

Another embodiment of the present invention employs an inwardly directed ridge on the lower edge of the inner guide skirt which permits the inner skirt to be thinner and more flexible than the inner skirt found on the prior art caps while still providing sufficient strength to the inner skirt to permit easy application and improved sealing of the cap with the inner lip of the bottle.

Still further the present invention teaches that the cap of the present invention can be used with a new, improved and substantially simpler bottle neck design having a more uniform and hence stronger neck portion while remaining compatible with existing bottle dimensions and application equipment.

DESCRIPTION OF THE PRIOR ART

Figure 1:
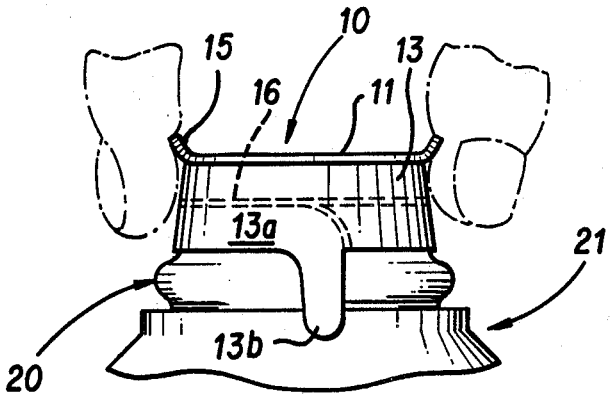
PRIOR ART FIG. 1
FIG. 1 is a side view of a typical prior art cap in its intended environment on the neck of a bottle.
Figure 2:
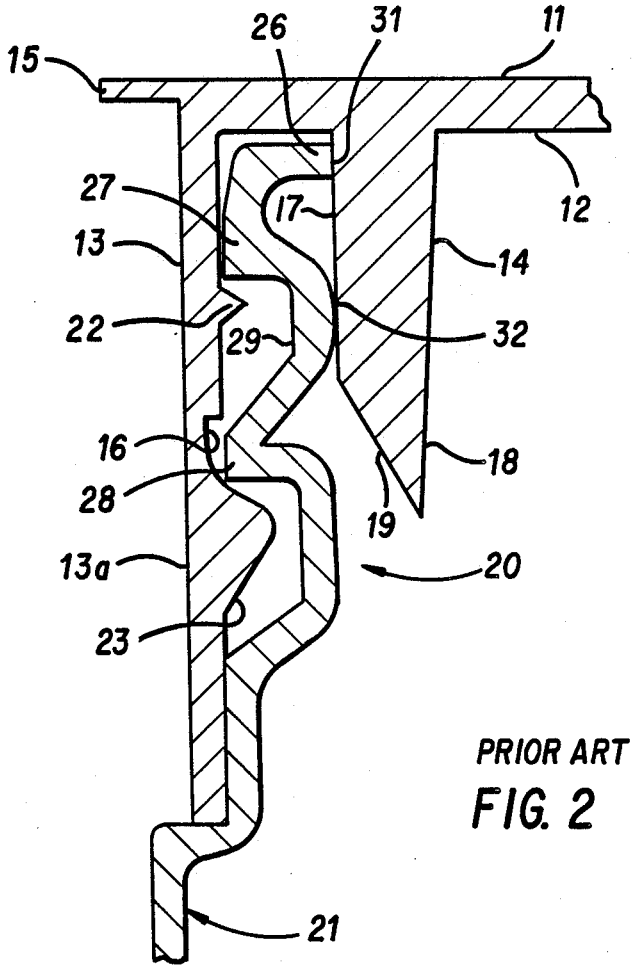
PRIOR ART FIG. 2
FIG. 2 is an enlarged partial section of the prior art cap of FIG. 1 in its intended environment on the neck of a bottle.
Figure 3:
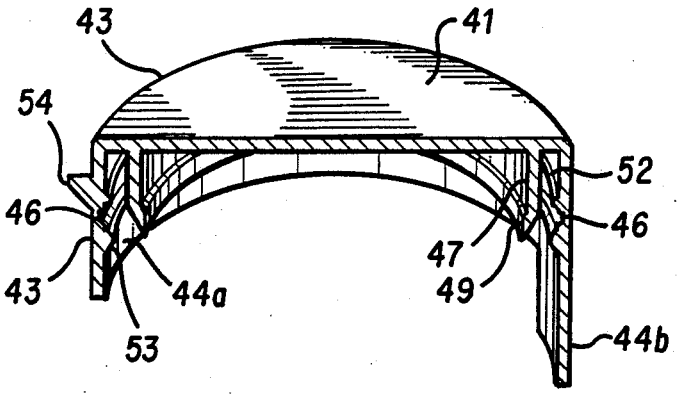
FIG. 3 is a sectional view of a cap according to a preferred embodiment of the invention.
Figure 4:
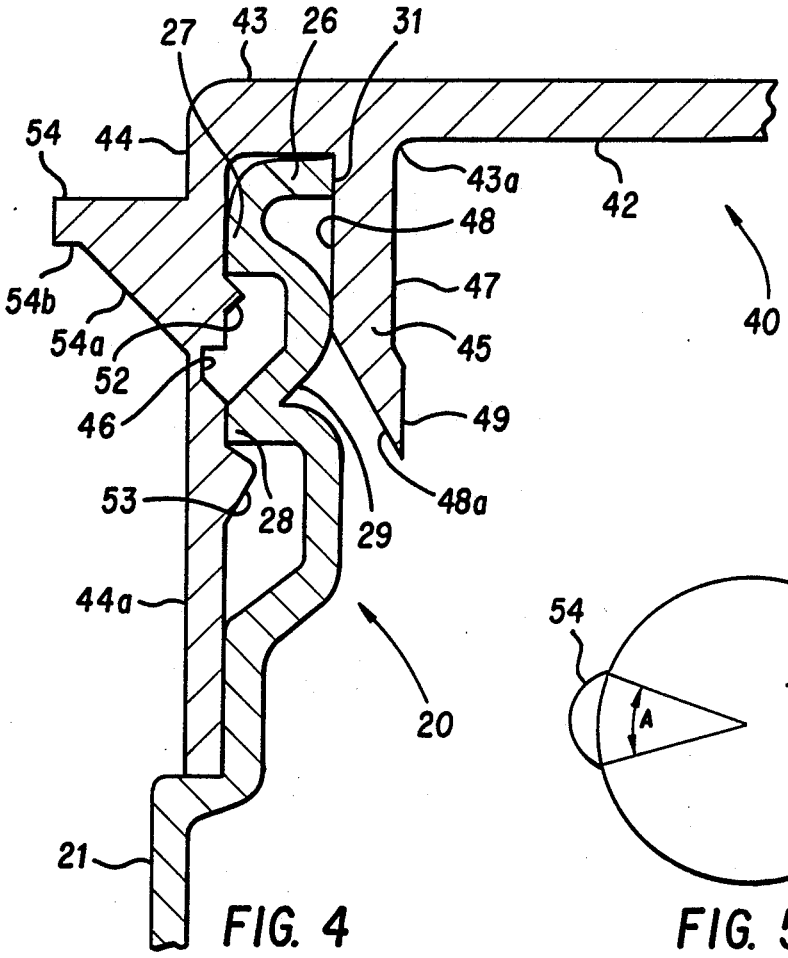
FIG. 4 is an enlarged partial section of FIG. 3 showing the cap of the present invention in its intended environment on the neck of a bottle.

FIGS. 1 and 2 illustrate one type of prior art press-on cap as it might be commonly found seated on the neck of a bottle. The cap comprises a flat disc 10 having a planar upper surface 11 and a planar under surface 12 and a cantilevered lip 15. Descending from the under surface 12 of the disc are outer and inner skirts 13 and 14. The outer skirt 13 is set in from the outer edge 15 of disc 11 and is provided with a lower tear ring **13*a* which is designed to to be removed from the bottom of the outer skirt by tearing at a score line 16, i.e. a thinned portion in the wall of the skirt 13. This tearing of the score line is accomplished by lifting and pulling a descending tab 13*b*. The inner guide skirt 14 has a vertical elongated outer wall 17, a vertical inner wall 18 and a lower, downwardly tapered, outer edge 19 extending from the outer wall 17 to the inner wall 18. This cap is shown seated on the neck 20 of a typical bottle 21**.

The inner wall of the outer skirt 13 is generally smooth except for a circumferential series of interrupted, small, generally V-shaped, upper internal ribs 22 and a circumferential series of interrupted, V-shaped, lower ribs 23. The lower ribs 23 are substantially larger than the upper ribs 22 and are positioned below the score line 16.

Typically the bottles on which such caps are used are often symmetrical about the axis of their neck, and generally are a blow molded polyethylene unit, having a suitably larger body merging to an externally beaded or threaded neck of reduced size. The container neck 20 is typically a cylindrical annulus having a sharply defined, inwardly directed, lip 26 having a precisely cut inner edge 31. The neck 20 also has an externally directed, horizontally undercut, peripheral bead 27 and a parallel, externally directed, horizontally undercut, lower peripheral bead 28 separated by an annular, inwardly directed, rounded swelling 29 between them.

The precisely cut inner edge 31 of the lip 26 and the inwardly directed, upper swelling 29 are designed to provide internal sealing surfaces with the vertical outer wall 17 of the inner skirt 14. The upper and lower externally directed beads 27 and 28 are designed to mesh with the internally directed ribs 22 and 23 on the outer skirt 13 and tear ring **13*a***.

The upper and lower beads 27 and 28, as shown, are generally L-shaped in cross section. The lower undercut surfaces of these beads interact with the ribs on the cap to provide the main cap retainer means.

Because the bottle and its neck are molded in a blow mold operation, separable dies are used to mold the neck. Because the dies may not be accurately aligned the precision of the beads 27 and 28 and especially the swelling 29 vary from molding machine to molding machine. Moreover such beads and the swelling 29 will have on them so called parting lines where the die parts meet one another.

Either wear or misalignment of the dies will greatly accentuate the parting lines.

Such parting lines, especially where they cross the swelling 29 can cause the seal, in the region of the sealing surface 32, i.e. where the swelling 29 meets the wall 17 of the inner skirt 14, to fail.

In some cases these accentuated parting lines can, by bearing on the wall 17 of the inner skirt 14, cause sufficient flexing or twisting of the cap such that the seal at the cut edge 31 of lip 26 to also fail and leak.

The present invention as will be discussed below prevents such leakage or seal failure from occurring.

DESCRIPTION OF THE INVENTION

FIGS. 3, 4, 5, 6 and 7 all are various views of and illustrate the improved cap 40 of the present invention which is formed as an integral synthetic plastic unit. The cap 40 has a flat upper surface 41, approximately 1⅜ inches in diameter, formed of a central region 42, typically 0.030 inches thick, and a thicker annular rim region 43, typically 0.040 inches thick, surrounding the central region 42. An outer, annular skirt 44, approximately 0.030 inches in thickness, descends smoothly from the outer edge of the surface 41. The juncture of surface 41 and the skirt 44 is slightly rounded so that it has the shape of a waterfall. An annular inner skirt 45, usually 0.040 inches thick, coaxial with outer skirt 44, serves as an interior seating guide and descends from the inner edge of the rim region 43 at its juncture with the central region 42. The rim 43, the outer skirt 44, and the inner skirt 45 form a generally U-shaped cavity into which the neck of a bottle fits.

The outer skirt 44 is provided with a lower tear ring **44*a* which is designed to be removed from the bottom of the outer skirt by tearing at a score line 46, i.e. a thinned portion in the wall of the outer skirt 44. Tearing of this score line is accomplished by lifting and pulling of a descending tab 44*b***.

The interior skirt 45 has a vertical inner wall 47, an outer wall 48 substantially parallel to the inner wall 47, an annular, coaxial ridge 49 formed by a 0.10 inch thick step on inner wall 47 and a downwardly and inwardly sloping outer wall region **48*a* behind ridge 49, this sloping wall portion 48*a* extends from a point above the ridge 49 on wall 48 to the bottom of ridge 49. The ridge 49 is of a height that is less than three fourths that of the height of the sloping portion 48*a*. The inwardly tapered inner wall 48*a* is set at an angle of between 20 and 40 degrees and provides a guiding function to assure quick and accurate seating of the cap on the bottle neck. The ridge 49 not only strengthens the lower edge of the inner skirt so that the thickness of the inner skirt may be greatly reduced from that thickness required by the prior art while allowing great flexibility in the inner skirt 45** thus assuring improved seating of the cap of the present invention on the bottle neck as will be further discussed below.

Outer skirt 44 is axially longer than inner skirt 45 when originally assembled on the bottle but is axially shorter than inner skirt 45 when tear ring **44*a* is detached. That is the inner skirt 45 extends below the tear ring 46**.

The interior wall of the outer skirt 44 is generally smooth except for a single continuous, circumferential, generally V-shaped upper rib 52, extending about 0.030 inches above the inner surface **44*a* of the outer skirt 44** towards the inner skirt 45, and a single, continuous, circumferential, generally V-shaped lower rib 53 which typically extends 0.025 inches above the surface 44*a* towards the inner skirt 45. The rib 52 can extend above this surface in the range of 0.010 inches to 0.060 inches. The lower rib 53 is substantially larger in mass than the upper rib 52 and is positioned below the score line 46 so that the score line falls between the ribs 52 and 53. The outer surface of the skirt 44 is smooth and interrupted only by a substantially rigid, arcuate, lifting tab 54 covering, an indicated by the angle A, about thirty degrees of the surface of the skirt. It has been found that this lip can cover up to about one quarter of the circumference of the rim, i.e. subtend an angle of about 90 degrees, without adversely affecting the present invention. This tab 54 extends 0.090 inches and at a right (90 degrees) angle to the outer surface of the outer skirt 44 and is supported underneath by an arcuate buttress 54*a*. Desirably this tab 54, when subtending an angle of 30 degrees has a radius of approximately 0.40 inches. The upper, planar surface of tab 54 is positioned approximately 0.090 inches below the upper surface of the rim 43 and is approximately 0.120 inches above the score line 46. The arcuate buttress 54*a* is formed with a lower surface sloped at an angle of approximately 45 degrees with respect to the surface of tab 54 and begins approximately 0.015 inches in from the outer edge of tab 54 thus creating a small overhanging ledge 54*b*. A release tab 44*b* descends from the tear ring 44 for easy manual removal of the tear ring 44*a* when the cap is to be removed from a container.

The caps of the present invention can be readily used with the blow molded polyethylene bottles of the prior art and thus the bottle in this figure uses the same number identification as that of FIG. 2. Again the neck 20 is typically a cylindrical annulus having, by cutting, a sharply defined, inwardly directed lip 26 and an externally directed, horizontally undercut, peripheral bead 27 and a parallel, externally directed, horizontally undercut, lower peripheral bead 28 having an annular inwardly directed swelling 29 between them.

After molding of the bottle, the lip 26 is cut to provide an internal smooth cylindrical sealing surface 31 with the inner surface 48 of the inner skirt 45. The upper and lower external beads 27 and 28, of the bottle, are designed to mesh with the internally directed ribs 52 and 53 on the outer skirt 44 and tear ring 44*a*.

The upper and lower beads 27 and 28, on the bottle, are generally L-shaped in cross section. The lower undercut surfaces of these beads provide the main cap retainer means while the tear ring 44*a* remains attached to the outer skirt 44.

The cap of the present invention is operatively mounted on the container by being pressed on over the open neck as will be discussed below.

In automatic machinery for installation of these caps on a container neck, the caps are usually fed in succession from the bottom of a stack and towards the container neck. A feature of the present invention is the ability of the inclined wall portion 48*a* of the outer wall 48 of the inner skirt 44 to center itself on the lip 26 during transfer of the cap onto the container neck regardless of the angel at which the cap approaches the neck. This ensures that the cap is applied to the neck such that the cut lip 26 is forced into its final sealing position in the U-shaped region.

When the cap 40 of the present invention is pressed onto the container neck, it is guided and centered by the the sloped lower wall potion 48*a* engaging and sliding past the cut lip 26 causing the lip 26 on the neck 50 to be guidably received within the U-shaped region formed by rim 43, outer skirt 44, and inner skirt 45, as the cap is pushed further onto the bottle. Because the lip 26 is precisely cut to the diameter of the inner wall 48 of the inner skirt 43 and because the lip 26 is cut after the bottle is molded no flash or defects remain on the sealing edge 31 and the sealing surface 31 slides along the inner wall 48 of the inner skirt until the lip 26 is firmly seated within the U-shaped region and the sealing surface 31 forms a firm sealing contact with the surface of the inner wall surface 48.

Because the ridge 49 stiffens the inner skirt 45, the portion of the wall of the skirt 45 lying above the ridge may be significantly thinned thus permitting the skirt 45 to flex as it is pressed on the neck of the bottle. This feature together with the sloped wall 48*a* assure centering of the cap on the neck regardless of the approach angle of the cap as it is applied to the bottle. The inherent flexibility of the outer skirt enables the ribs 52 and 53, on the outer skirt 44 to cam outwardly just enough to pass the bottle neck beads 27 and 28. After the ribs pass the neck beads the outer skirt returns to its initial shape. In this way the primary locking rib 53 co-acts with neck bead 28 to prevent unauthorized removal of the cap from the container. Simultaneously the cut edge of the lip 26 forms a liquid tight seal at surface 31 between the inner surface 48 of the inner skirt 45 and the cut edge of lip 26.

Because the rim region 43 is thicker than the central disk and because the the inner skirt 45 is flexible a positive pressure is applied between the inner wall surface 48 of inner skirt 45 and the cut edge of lip 26 such that positive sealing occurs at all times at surface 31. Also, because the central region 42 is thinner than the rim region 43, the juncture 43*a* where the central region and the rim join together acts as a living hinge such that the central disk can flex without causing the inner skirt interior wall 48 to break its seal with the cut lip seating surface 31. This reduces the possibility of leakage when the bottle's internal pressure rises.

Furthermore this cap thwarts any attempt to remove the cap, from the bottle upon which it has been placed, before removal of the tear ring 44*a*, because the smoothness and smallness of the arcuate perpendicular beveled tab 54 prevents sufficient exterior lifting pressure from being applied to the cap which would be sufficient, with the tear ring unruptured, to flex or bend the outer skirt enough to permit the ribs to pass by the neck beads.

Moreover by placing the outer lifting lip 54 below the the upper edge of the rim region 43 the effectiveness of the interlocking action of the ribs and the beads, during lifting of the cap with the tear ring attached, is further enhanced when a lifting force is applied because of the inwardly directed vector of force resulting from the sloping buttress 54*a*.

When it is desired to open the container, the tab 44*b* must be gripped and twisted, rupturing the wall of the outer skirt 44 along the weakened score line 46 until the tear ring 44*a* is entirely removed from the cap.

Once the tear ring 44*a* is removed the outer skirt consists only of the upper portion 43 above the score line 46 and the cap may be readily removed because the outer wall now flexes enough such that rib 52 passes i.e. cams over, the the upper bead 27. This occurs with only an easy upward pressure being applied to the protruding tab 54. In the event the bottle is not emptied, the cap may be easily remounted over the bottle neck and still provide both a sufficient holding action to prevent accidental removal of the cap and good seating and sealing action between the lip 26 and the inner wall 48 of the inner skirt 44.

Thus there has been described a cap formed to guide itself reliably onto a sealed and locked position when simply pushed onto the container neck, and which cannot be removed with twisting or pulling without removal of the external lower skirt by pulling on the tab **44*b***.

Figure 5:
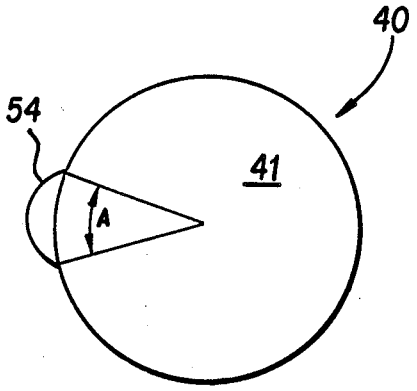
FIG. 5 is a top view of the cap of the present invention.
Figure 6:
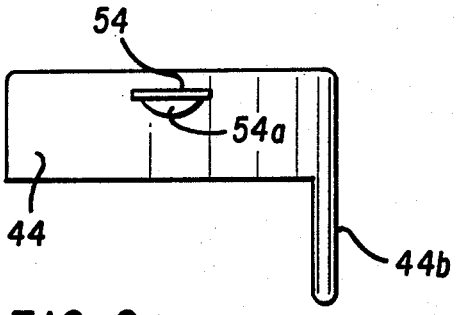
FIG. 6 is a side view of the top of the present invention with the tear ring intact.
Figure 7:
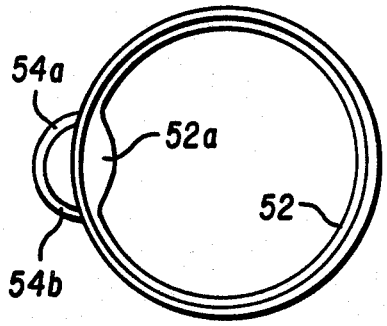
FIG. 7 is a bottom view of the top of the present invention.

Referring, in greater detail, to FIGS. 5, 6 and 7 it should be noted that the tab 54 is arcuate in form and this arcuate form, in conjunction with the angled buttress **54*a* prevents anyone from having a large enough bearing surface against which lifting, rotational forces can be applied which are sufficient to force the cap off the bottle while the lower outer skirt 44*a* remains attached. The angled buttress 54*a* is such that any force applied thereto before the lower skirt 44*a* is removed causes the upper bead to more firmly seat against the respective rib with which it is aligned thus the unauthorized removal of the caps is made still more difficult. This occurs because the lower skirt 44*a* stiffens the entire structure and prevents the upper cap edge 44 from flexing sufficiently to permit the bead 52 from riding over the rib 27. Moreover the angled supporting buttress reduces the amount of force that a finger or thumb can apply to the cap, for as the finger applies greater lifting force it is caused to slip upwards along the slope of the buttress. As the finger slips upward, the normal human reaction is to apply still more inward pressure. This increased pressure causes the interference between rib 52 and bead 27 to increase thus making it still more difficult to remove the cap. However the small lip 54*b* that extends beyond the buttress 54*a*** provides sufficient grip for the force the user's finger need apply to remove the cap after the lower tear band has been removed. Thus this lip allows the user to easily lift off the cap once the tear band has been removed and yet is so small as to not permit sufficient lifting force to be applied as to cause the ribs to slip past the beads prior to removal of the tear band.

It should be noted in FIG. 7 that the upper rib 52 can be made slightly enlarged, i.e. the inwardly directed bump **52*a*, at a point opposite the lifting tab 54. This bump 52*a* extends approximately 0.030 to 0.050 inches above the remainder of the surface of the rib and towards the center of the disk. The addition of this bump 52*a* has been found to significantly increase the holding power of the cap prior to the time the lower tear ring 44** is removed without affecting the removal of the cap after the lower tear ring is removed.

Figure 8:
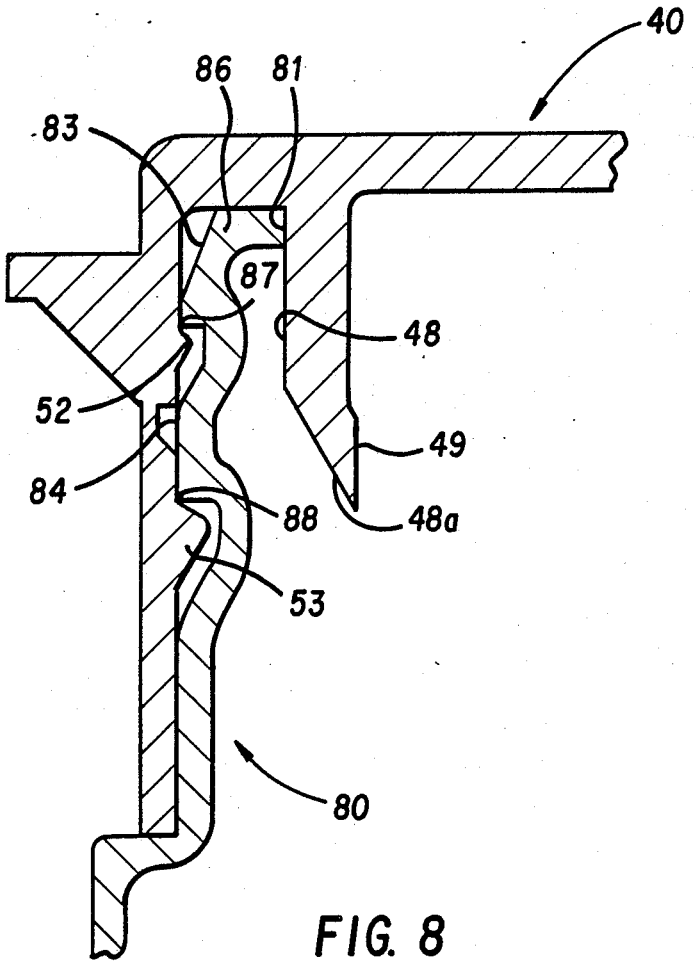
FIG. 8 is an enlarged partial section of FIG. 3 showing the cap of the present invention in its intended environment on a bottle having a new and improved neck design.

In FIG. 8 there is shown, in partial cross section, the neck of an improved bottle which will accept both the new cap of the present invention as well as the caps of the prior art. This newly created bottle neck design is one in which the internal swelling and mating recess for the lower rib has been greatly reduced over that of the prior art bottle neck design. By substantially reducing such horizontal sections, i.e. the swelling, in the neck of the bottle, more material is directed to the vertical sections, thus making the neck stiffer. This results in a stronger bottle neck because the cross sectional thickness of the material in the neck remains substantially uniform, i.e. between 0.020 and 0.030 inches in thickness, through out its entire length. This permits a reduction in the size of the upper bead, on the cap, which, in turn, requires less pressure to apply the cap both before and after the tear band has been removed.

As in the prior art, the bottle is symmetrical about the axis of its neck, and has a blow molded body merging to an externally beaded neck of reduced size. Again the container neck 80 is typically a cylindrical annulus with a sharply defined, inwardly directed, lip 86 having a precisely cut inner edge 81. The neck also has an externally directed, horizontally undercut, upper peripheral bead 87 and a parallel, externally directed, horizontally undercut, lower peripheral bead 88.

By redesigning the upper and lower beads 87 and 88 as shown in FIG. 8 and as described below significant benefits are realized.

The upper and lower beads 87 and 88, as shown, are generally L-shaped in cross section with sharp undercut ledges defining the upper surfaces of the recesses in which the ribs on the cap interact and become located thereby to provide the main cap retainer means.

The several distinct features of the present invention include the inclined wall surface 83 between the lip 86 and the upper bead 87 as well as the extended vertical wall surface 84 lying between the beads 87 and 88.

When the cap 40 of the present invention is pressed onto this improved container neck, the lower rib 53, on the cap, begins to slide over the neck and the cap is then guided and centered by the the sloped portion **48*a* engaging and sliding past the cut lip 26. As the juncture of the slope 48*a* with the wall 48 slides past the lip the lower rib 53 begins riding over the vertical surface 84 following which the upper rib 52 begins sliding along the slope 83. Then after the lower rib 53 passes the lower edge of the bead 88 the upper rib also passes the lower edge of the upper bead 87. When both ribs 52 and 53 so pass the lower edge of the respective beads 87 and 88 the cap is secured on the bottle. This use of a larger bead 87** provides a greater snap action when the customer replaces the cap after the tear ring has been removed thus increasing customer confidence that a good seal has been obtained.

The invention may be embodied in other specific forms without departing from the spirit of essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A molded plastic cap having a central disk having a substantially uniform thickness, a rim region surrounding said central disk, a thin walled outer skirt downwardly descending from the outer edge of the rim, a score line extending circumferentially around the outer skirt to divide the skirt into an upper section and a lower tear ring section, a substantially circumferential rib on the inner wall of said outer skirt below said score line, and an inner, positive sealing, guide skirt descending from the inner edge of said rim region, characterized by a substantially rigid, arcuate, buttressed lifting tab perpendicular to and positioned on the exterior surface of said outer skirt, and covering less than 25% of the circumference of the outer surface of the outer skirt and supported substantially beneath its entire surface by a smooth, arcuate buttress.

2. The cap of claim 1 wherein said tab is positioned below the uppermost surface of said rim a distance substantially halfway between the upper surface of said central disk and the score line on said outer skirt.

3. The cap of claim 1 wherein there is provided a lifting lip on said tab which extends beyond said buttress.

4. The cap of claim 1 wherein said rim region is thicker than said central disk.

5. The cap of claim 1 wherein said inner skirt extends below the score line on said outer skirt.

6. A molded plastic cap having a central disk having a substantially uniform thickness, a rim region surrounding said central disk, a thin walled outer skirt downwardly descending from the outer edge of the rim, a score line extending circumferentially around the outer skirt to divide the skirt into an upper section and a lower tear ring section, a substantially circumferential rib on the inner wall of said outer skirt below said score line, and an inner, positive sealing, guide skirt descending from the inner edge of said rim region, characterized by an arcuate tab perpendicular to and positioned on the exterior surface of said outer skirt, and an arcuate buttress supporting said tab, said tab being positioned below the uppermost surface of said rim a distance substantially halfway between the upper surface of said central disk and the score line on said outer skirt, wherein said inner skirt has a vertical inner wall, a vertical outer wall, a downwardly and inwardly sloping lower region on said outer wall and a ridge protruding from the lower portion of said inner wall opposite said sloping region on said outer wall.

7. The cap of claim 6 wherein said inwardly tapered inner wall is at an angle of between 20 and 40 degrees to the vertical and provides a guiding function to assure quick and accurate seating of the cap on the bottle neck.

8. The cap of claim 6 wherein said interior wall of the outer skirt is smooth except for an upper generally V-shaped, continuous, circumferential internal rib and a lower generally V-shaped, continuous, circumferential inner rib, the lower rib being substantially larger than the upper rib and positioned below the score line.

9. The cap of claim 6 wherein the outer surface of the outer skirt is smooth and interrupted only by a substantially rigid, arcuate, buttressed lifting tab covering less than 25% of the circumference of the outer surface of the outer skirt and which is supported substantially beneath its entire surface by a buttress.

10. The cap of claim 6 wherein said ridge protrudes 0.010 inches above the the said inner wall and has a height less than three fourths the height of said sloping region.

* * * * *